US008711538B2

(12) United States Patent
Woodworth et al.

(10) Patent No.: US 8,711,538 B2
(45) Date of Patent: Apr. 29, 2014

(54) EXTERNALLY GAPPED LINE ARRESTER

(76) Inventors: Jonathan Jay Woodworth, Olean, NY (US); Deborah Lynn Limburg, Olean, NY (US)

( * ) Notice: Subject to any disclaimer, the term of this patent is extended or adjusted under 35 U.S.C. 154(b) by 357 days.

(21) Appl. No.: 13/253,362

(22) Filed: Oct. 5, 2011

(65) Prior Publication Data

US 2012/0087055 A1 Apr. 12, 2012

Related U.S. Application Data

(60) Provisional application No. 61/390,218, filed on Oct. 6, 2010.

(51) Int. Cl.
*H01C 7/12* (2006.01)
*H01T 1/14* (2006.01)

(52) U.S. Cl.
USPC ..... 361/127; 361/125; 361/10; 361/11

(58) Field of Classification Search
USPC ..... 361/127, 125, 10, 11
See application file for complete search history.

(56) References Cited

U.S. PATENT DOCUMENTS 3,017,539 A * 1/1962 Robinson ..... 361/125
3,474,995 A * 10/1969 Amidon et al. ..... 248/218.4
5,172,297 A * 12/1992 Imakoma et al. ..... 361/126
5,237,482 A * 8/1993 Osterhout et al. ..... 361/117
5,400,207 A * 3/1995 Krause ..... 361/117
5,426,555 A * 6/1995 Lundquist ..... 361/117
2011/0216463 A1 * 9/2011 Kester et al. ..... 361/118

OTHER PUBLICATIONS

Woodworth, J., Arrester Disconnector, ArresterFacts 005, May 4, 2008, ArresterWorks, USA.
Woodworth, J., What is a Transmission Line Arrester, ArresterFacts 017, Mar. 6, 2009, ArresterWorks, USA.

* cited by examiner

*Primary Examiner* — Rexford Barnie
*Assistant Examiner* — Zeev V Kitov
(74) *Attorney, Agent, or Firm* — Law Offices of Michael L. Wise, LLC

(57) ABSTRACT

An arrester for preventing an insulator supporting a power line from experiencing an electrical flashover comprises an electrode, a varistor, and a separating device. The electrode is spaced apart from the power line or a conductor that is electrically tied to the power line so as to define an external gap therebetween. The separating device, in turn, comprises two portions operative to separate from one another when the varistor experiences an electrical condition sufficient to cause the varistor to fail. The electrode, the external gap, the separating device, and the varistor are arranged in electrical series with one another and in electrical parallel with the insulator.

19 Claims, 4 Drawing Sheets

EXTERNALLY GAPPED LINE ARRESTER

FIELD OF THE INVENTION

The present invention relates generally to high voltage electrical power station, transmission, and distribution systems, and, more particularly, to line arresters for use in protecting such systems.

BACKGROUND OF THE INVENTION

Externally Gapped Line Arresters (EGLAs) are a type of line arrester used to mitigate the effects of lightning strikes and electrical surges on electrical power line equipment. An EGLA is typically installed in electrical parallel with an insulator that acts to support a power line. With such an EGLA in place, lightning strikes or other types of voltage surges that might cause the insulator to experience flashover are instead diverted to the ground. Damaged equipment and service interruptions are thereby avoided.

While not utilized extensively in the United States, EGLAs have been in production and use in Japan and other foreign countries for several years. A typical EGLA comprises an external gap in series with a series varistor unit (SVU). The SVU, in turn, comprises non-linear metal oxide resistors (MORs) encapsulated in a polymer housing. Because of the non-linear behavior of MORs, the SVU exhibits high resistance at normal operating voltages, but rapidly becomes a low resistance pathway at higher applied voltages such as those produced by lightning strikes. The external gap, because it is arranged in series with the SVU, must spark over before the SVU can begin to conduct electricity.

Unfortunately, it is possible for an SVU in a conventional EGLA to experience a voltage condition during a lightning strike or other surge event sufficient to cause that SVU to fail and not revert back to its original high resistance state when the strike or surge is over. With such a failed SVU, system basic impulse level (BIL) is compromised and the EGLA no longer provides optimal protection for the equipment that it is intended to protect. Nevertheless, because SVUs are normally constructed with polymer housings for purposes of strength and explosion control, there is frequently no obvious outer indication that an SVU has failed. This makes the tracking down and repair of failed EGLAs particularly difficult for the utilities charged with maintaining that equipment.

SUMMARY OF THE INVENTION

Embodiments of the present invention provide EGLA designs that may be used to prevent insulators on utility poles from experiencing flashover as a result of lightning strikes or other electrical surge events.

In accordance with aspects of the invention, an arrester for preventing an insulator supporting a power line from experiencing an electrical flashover comprises an electrode, a varistor, and a separating device. The electrode is spaced apart from the power line or a conductor that is electrically tied to the power line so as to define an external gap therebetween. The separating device, in turn, comprises two portions operative to separate from one another when the varistor experiences an electrical condition sufficient to cause the varistor to fail. The electrode, the external gap, the separating device, and the varistor are arranged in electrical series with one another and in electrical parallel with the insulator.

Advantageously, the above-described embodiments provide several benefits over conventional EGLAs. Embodiments of the invention, for example: 1) provide a visual indication after an SVU failure; 2) allow the BIL of the insulator to be restored after an SVU failure to a value that it would have without a line arrester rather than being diminished; 3) do not allow parts to fall to the ground when an SVU failure occurs; and 4) may be configured for use with many different types of insulators.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1:
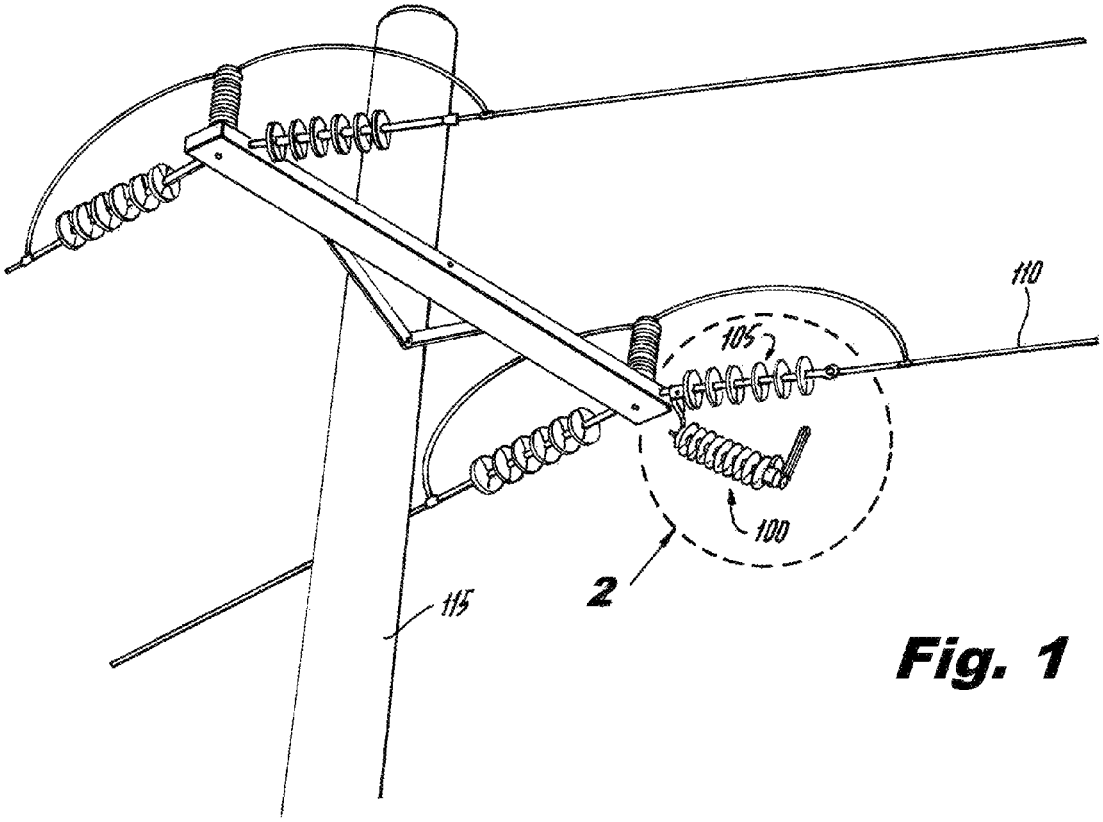
FIG. 1 shows a perspective view of a line arrester according to a first illustrative embodiment of the invention in association with an insulator on a utility pole.
Figure 2:
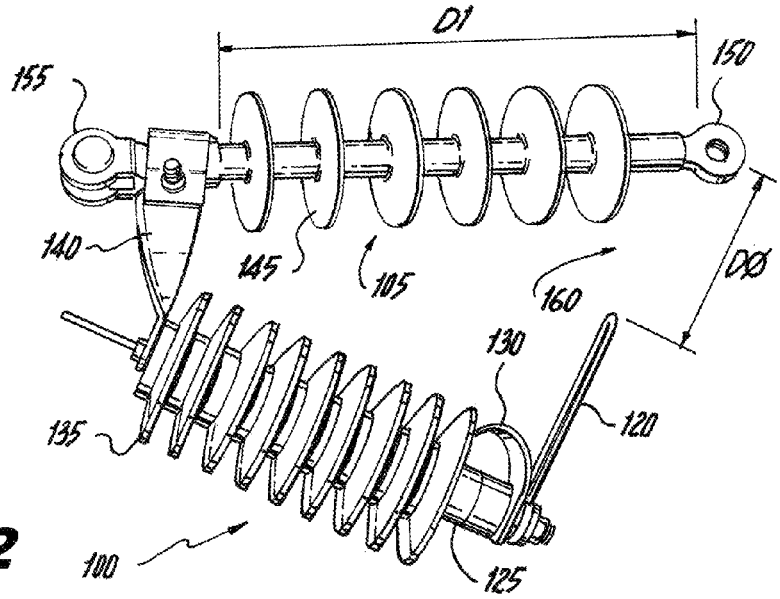
FIG. 2 shows an enlarged perspective view of the FIG. 1 line arrester and insulator.
Figure 3:
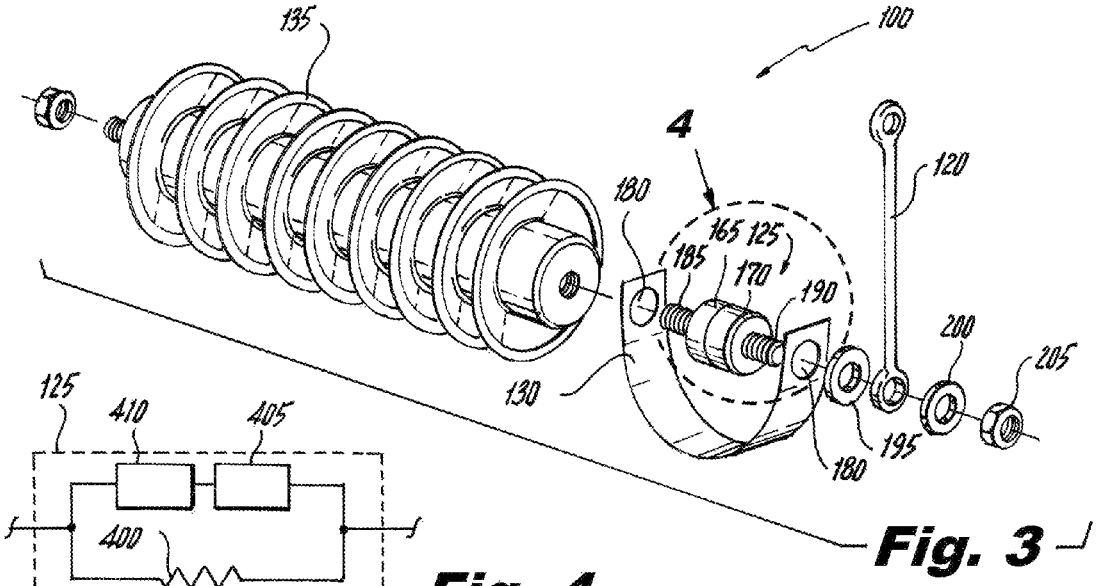
FIG. 3 shows an exploded perspective view of the FIG. 1 line arrester.

FIGS. 1-3 show several views of a line arrester 100 in accordance with an illustrative embodiment of the invention. For purposes of illustration, the line arrester 100 is presented in association with an insulator 105 tasked with supporting a power line 110 on a utility pole 115. FIG. 1 shows a perspective view of the line arrester 100 and the insulator 105 as they might be configured when installed on the utility pole 115. FIG. 2 shows an enlarged perspective view of the line arrester 100 and the insulator 105. Lastly, FIG. 3 shows an exploded perspective view of at least some of the elements of the line arrester 100 itself.

The illustrative line arrester 100 comprises an electrode 120, a separating device 125, a strap 130, an SVU 135, and a bracket 140. In the present embodiment, the insulator 105 is what is commonly called a "dead end insulator," although this choice for the type of insulator is largely arbitrary. The insulator 105 comprises an insulator body 145 terminated at both ends by a respective conductive end fitting. As displayed in FIGS. 1 and 2, the rightmost end fitting forms a line terminal 150, while the leftmost end fitting forms an earth terminal 155. When in use, the line terminal 150 is preferably attached to and electrically tied to the power line 110. The earth terminal 155, in contrast, is preferably tied to an earth (ground) potential.

Again referring to FIGS. 1-3, one end of the electrode 120 is coupled to the separating device 125, while the opposite end terminates in the air. The air-terminated end of the electrode 120 is precisely spaced apart from the line terminal 150, defining an external gap 160 therebetween. The external gap 160 is characterized by a distance D0. Opposite the electrode 120, the separating device 125 is coupled to the SVU 135. The SVU 135, in turn, is coupled to the bracket 140, which, in this particular embodiment, ties that end of the line arrester 100 to the earth terminal 155 on the insulator 105. The external gap 160, the electrode 120, the separating device 125, the SVU 135, and the bracket 140 are thereby arranged in electrical series with each other and in electrical parallel with the insulator 105. Finally, the strap 130 spans between two ends of the separating device 125.

The SVU 135 preferably comprises one or more non-linear resistors (i.e., varistors) that exhibit high resistances at normal applied voltages and much lower resistances at higher applied voltages such as those produced by lightning strikes. The non-linear resistors of the SVU 135, may, for example, comprise one or more metal oxide elements such as, but not limited to, disks formed at least in part by zinc oxide. Commercial sources of suitable SVUs may include, for example, Hubbell Power Systems (Centralia, Mo., USA), ABB (Norwalk, Conn., USA), Siemens AG (Erlangen, Germany), and Cooper Power Systems (Dublin, Ireland). As described earlier, although generally robust, such SVUs may fail (i.e., enter a state wherein they are permanently in a lower resistance state) when exposed to extreme electrical conditions. Accordingly, the SVU 135 is preferably housed in a polymer housing to provide both weatherproofing and strength against electrically-induced explosions.

Figure 4:
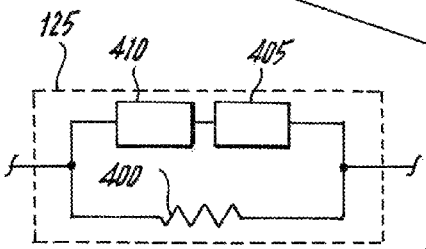
FIG. 4 shows a simplified schematic diagram of at least some of the elements within a separating device in the FIG. 1 line arrester.

For electrical continuity between the electrode 120 and the SVU 135, the separating device 125 preferably provides a low resistance pathway for electrical current until it is exposed to a voltage and associated current flow sufficient to cause the SVU 135 to fail. The separating device 125 may, for example, take the form of a conventional ground lead disconnector (also sometimes called an "isolator"). Such ground lead disconnectors are commercially available from, as just two examples, DHGate.com (Beijing, China) and Zhejiang Smico Electric Power Equipment Co., Ltd. (Zhejiang, China). FIG. 4 shows a simplified schematic diagram of at least some of the elements within the separating device 125. The separating device 125 comprises a bypass element 400, a heating element 405, and a separation element 410. During normal, steady state operations, electrical current is conducted primarily through the bypass element 400 and the heating element 405 is only nominally heated. When, in contrast, a lightning strike or other power surge occurs that is sufficient to cause the SVU 135 to fail, excessive fault current causes the heating element 405 to heat to a point where it activates the separation element 410. The separation element 410 is preferably a small explosive device which is heat activated. The exploding separation device 410 acts to split the separating device 125 into two portions. In the present case, a first portion 165 remains attached to the SVU 135, while a second portion 170 remains attached to the electrode 120.

As will be further described below, the strap 130 is operative to span between the two portions 165, 170 of the separating device 125 after the separating device 125 is activated. Accordingly, the strap 130 preferably comprises a flexible material of sufficient strength to support the weight of at least the second portion 170 and the electrode 120. The strap 130 will also preferably be of a high enough electrical resistance to not act as a significant current pathway in electrical parallel with the separating device 125, while also being sufficiently heat resistant to withstand any heat generated by the separating device 125 and any localized electrical arcing. Suitable materials for the strap 130 may include, as just two examples, Nomex® or Kevlar®, both available from DuPont (Wilmington, Del., USA).

FIG. 3 shows one manner in which the strap 130 can be secured to the separating device 125, although this particular configuration is merely illustrative and ultimately any suitable means of attachment would still fall within the scope of the invention. In this non-limiting embodiment, the strap 130 comprises two holes 180 positioned proximate to the strap's respective ends. A first threaded pin 185 emanating from the first portion 165 of the separating device 125 passes through one of these holes 180 and is screwed into the SVU 135. A second threaded pin 190 emanating from the second portion 170 of the separating device 125 is passed through the other hole 180 in the strap 130 and, after passing through a first washer 195, a hole in the electrode 120, and a second washer 200, is ultimately secured by a nut 205. The second threaded pin 190 and associated securing hardware 195, 200, 205 thereby act to capture both the strap 130 and the electrode 120.

Finally, the electrode 120 and the bracket 140 preferably comprise a conductive material such as brass, iron, aluminum, stainless steel, or the like.

Once so configured, the line arrester 100 may act to protect the insulator 105 from flashover between the line terminal 150 and the earth terminal 155. If a voltage surge is of sufficient amplitude to spark over the insulator 105 across strike distance D0, the surge is instead diverted across external gap 160 into the SVU 135, which almost instantly becomes a low resistance pathway. In this manner, the surge is directed into the bracket 140 and ultimately to the earth terminal 155 (i.e., ground potential), thereby bypassing the insulator 105 altogether. Assuming that the SVU 135 does not fail, the SVU 135 again returns to its high resistance state and cuts off the current flow after the surge charge has been reduced in amplitude, effectively ending the diversion event. The line arrester 100 remains intact and ready to divert additional surges as necessary.

If, instead, the electrical surge is sufficient to fail the SVU 135, a very different sequence of events occurs. In response to the overloading of the SVU 135, the separating device 125 preferably activates and separates into the first portion 165 and the second portion 170, as detailed above. The first portion 165 of the separating device 125 remains coupled to the SVU 135, while the second portion 170 remains coupled to the electrode 120. Gravity or, alternatively, a non-conductive spring built into the separating device 125, then causes the second portion 170 and the electrode 120 to fall away from the remainder of the line arrester 100 until their fall is arrested by the strap 130. At the end of this sequence of events, the second portion 170 of the separating device 125 and the electrode 120 end up suspended from the first portion 165 of the separating device 125 by the strap 130. Such a "failed" condition is shown in the perspective view in FIG. 5.

Figure 5:
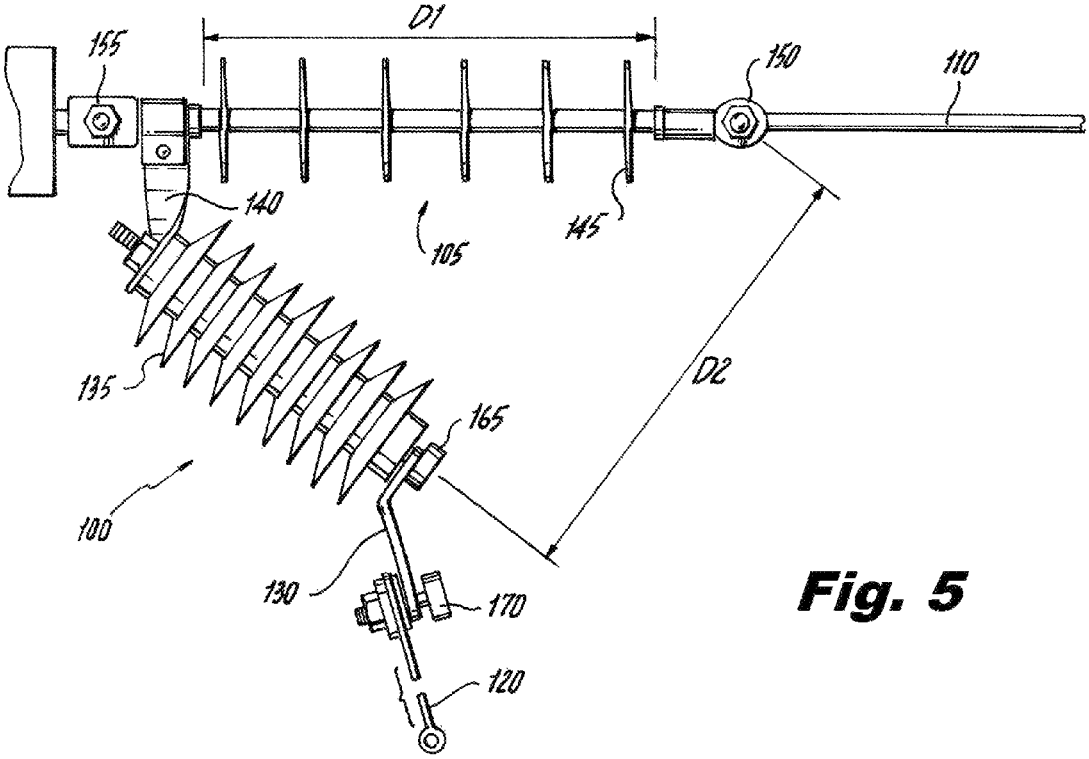
FIG. 5 shows a perspective view of the FIG. 1 line arrester after an SVU failure.

Notably, the illustrative line arrester 100 provides several advantages when compared to a conventional EGLA. With the electrode 120 suspended below the remainder of the line arrester 100 after failure of the SVU 135, as shown in FIG. 5, the distance between the first portion 165 of the separating device 125 and the line terminal 150 becomes D2. Advantageously, if the distance D2 is similar to or greater than the distance D1, as is preferable, the strike distance of the insulator 105 is again D1. In other words, the capacity of the insulator 105 to experience flashover is reset to the capacity of the insulator 105 to experience flashover without the line arrester 100. Accordingly, the BIL of the system is reestablished to about what it would be without the line arrester 100. In contrast, a conventional EGLA, arranged in a manner similar to the line arrester 100, but without a separating device like the separating device 125, would exhibit very different electrical characteristics. More particularly, despite an SVU failure, the electrode of the conventional EGLA would remain configured as it had been before the failure occurred. The external gap of the conventional EGLA would thereby be maintained even though the SVU had been overloaded and was in a permanent low resistance state. The external gap distance D0 of the conventional EGLA would then be the critical strike distance that governs the insulator 105. As a result, in contrast to the line arrester 100, system BIL with a conventional but failed EGLA would be substantially diminished because D0 is shorter than D1.

What is more, the illustrative line arrester 100 is also advantageous because the portions of the line arrester 100 suspended by the strap 130 after a failure, namely, the second portion 170 of the separating device 125 and the electrode 120, provide an excellent visual indicator that the line arrester 100 has been overloaded, which is not present in conventional EGLAs. Such a visual indicator, which may be seen at substantial distances, makes the discovery and repair of failed line arresters such as the line arrester 100 substantially easier. At the same time, the strap 130 assures that no parts are allowed to depart the line arrester 100 and fall from the utility pole 115 when a failure occurs. Thus, people and property underneath the utility pole 115 are protected from falling objects.

Figure 6:
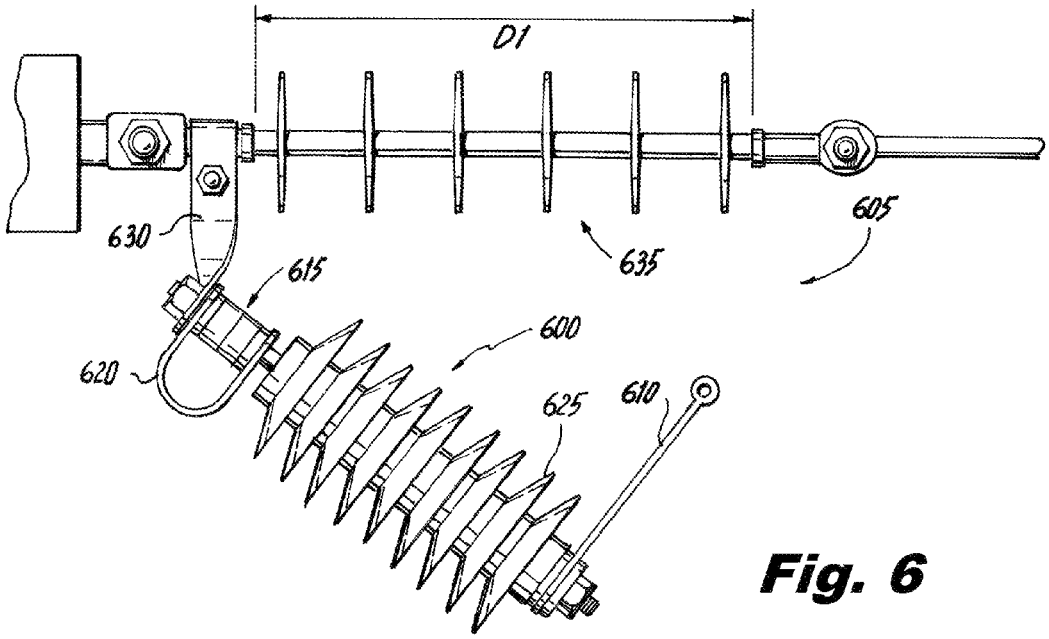
FIG. 6 shows a perspective view of a line arrester according to a second illustrative embodiment of the invention in association with an insulator.

FIG. 6 goes on to show a perspective view of a slightly modified version of the line arrester 100, namely, a line arrester 600 in accordance with a second illustrative embodiment of the invention. In a manner similar to the line arrester 100, the line arrester 600 comprises an external gap 605, an electrode 610, a separating device 615, a strap 620, a series varistor unit (SVU) 625, and a bracket 630. Here too, the external gap 605, the electrode 610, the separating device 615, the SVU 625, and the bracket 630 are arranged in electrical series with each other while being in electrical parallel with an insulator 635 that they act to protect.

Figure 7:
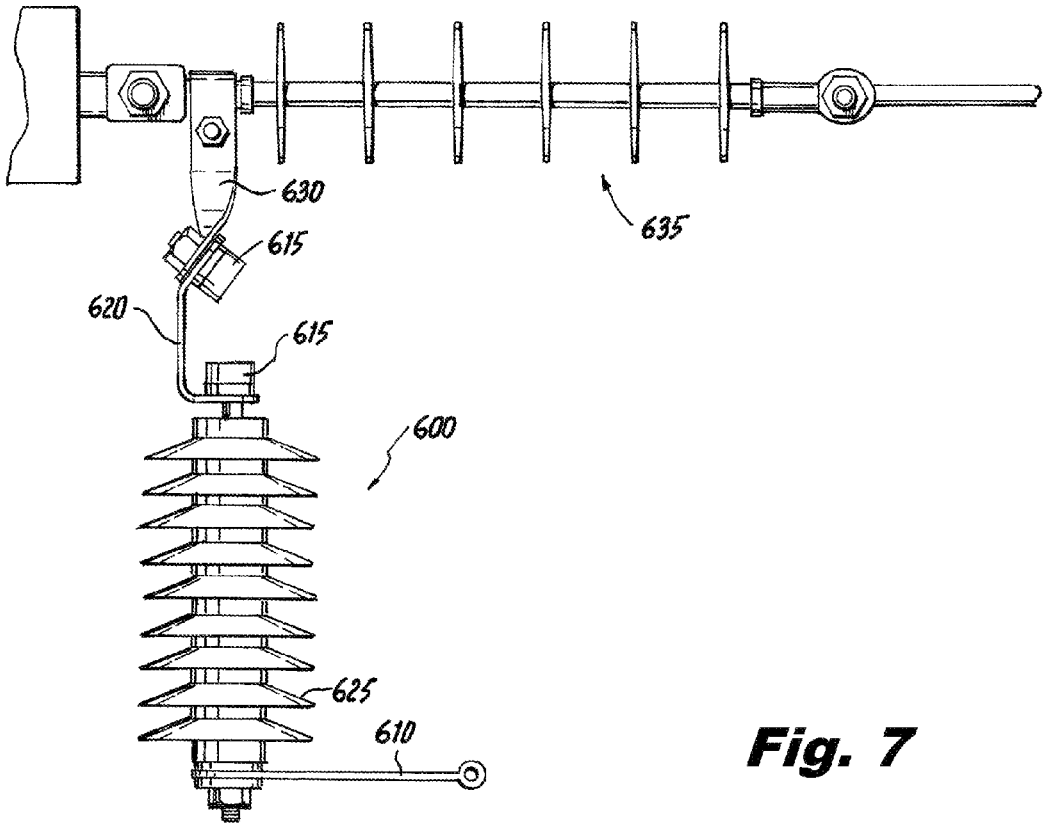
FIG. 7 shows a perspective view of the FIG. 6 line arrester after an SVU failure.

Nevertheless, in the line arrester 600, the separating device 615 and the strap 620 are coupled between the SVU 625 and the bracket 630 rather than being coupled between the SVU 625 and the electrode 610 in the manner of the line arrester 100. Accordingly, upon failure of the SVU 625 and the activation of the separating device 615, the SVU 625 and the electrode 610 end up suspended below the remainder of the line arrester 600, as shown in the perspective view in FIG. 7. For this reason, the strap 620 may need to be somewhat stronger than the strap 130. That said, with the SVU 625 and the electrode 610 suspended in this manner, the critical strike distance for the insulator 635 again reverts to about D1, the value it would have been if the line arrester 600 had never been installed. At the same time, the suspended SVU 625 and the suspended electrode 610 act as excellent visual indicators of the failure, and, as before, no parts are allowed to drop from the utility pole 115 as a result of that failure.

While the previous two illustrative embodiments were described in terms of protecting a dead end type of insulator (i.e., insulators 105 and 635), aspects of the invention may be utilized with a wide assortment of different types of insulators that are commonly mounted on utility poles. These include, but art not limited to post-type, suspension-type, pin-type, and crossarm-type insulators, and the like. Such insulators and other aspects of power transmission and distribution are described in, for example, A. R. Hileman, *Insulation Coordination for Power Systems*, Marcel Dekker, Inc., New York, 1999, which is hereby incorporated by reference herein.

Figure 8:
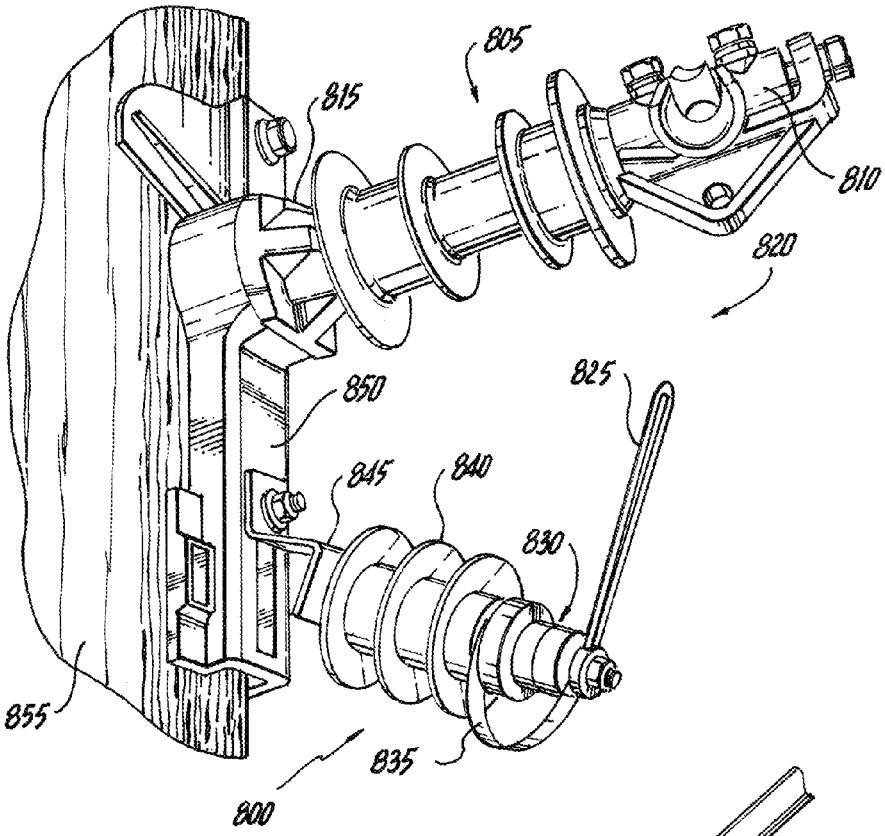
FIG. 8 shows a perspective view of a line arrester according to a third illustrative embodiment of the invention in association with an insulator on a utility pole.

FIG. 8, for example, shows a perspective view of a line arrester 800 in accordance with a third illustrative embodiment of the invention. In this case, the line arrester 800 is configured to protect a horizontal post insulator 805 with a line terminal 810 and an earth terminal 815. In a manner again similar to the line arrester 100, the line arrester 800 comprises an external gap 820, an electrode 825, a separating device 830, a strap 835, an SVU 840, and a first bracket 845. The first bracket 845 is in electrical communication with the earth terminal 810 of the horizontal post insulator 805 through a second bracket 850, which is directly attached to a utility pole 855 and is preferably tied to earth potential. Configured in this manner, the line arrester 800 functions in substantially the same manner as the line arrester 100 described in detail above.

Figure 9:
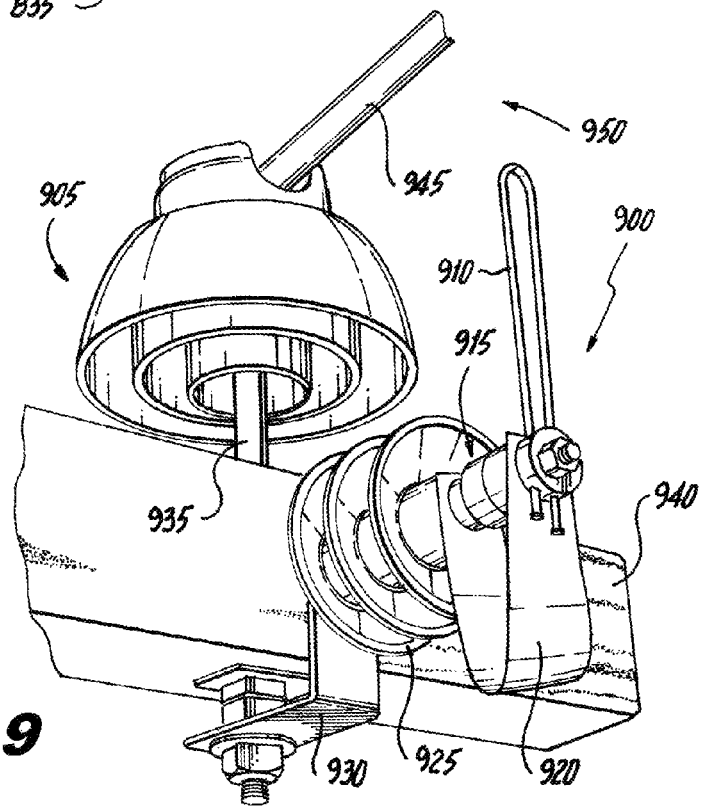
FIG. 9 shows a perspective view of a line arrester according to a fourth illustrative embodiment of the invention in association with an insulator on a utility pole.

As even another example, FIG. 9 shows a perspective view of a line arrester 900 in accordance with a fourth illustrative embodiment of the invention configured to protect a pin insulator 905. Here, the illustrative line arrester 900 comprises an electrode 910, a separating device 915, a strap 920, an SVU 925, and a bracket 930. The bracket 930, in turn, is coupled to a pin 935 that passes through a crossbeam of a utility pole 940 and acts to form an earth terminal for the pin insulator 905. A power line 945 is supported by the pin insulator 905 and combines with the electrode 910 to define an external gap 950. Again, in such a configuration, the line arrester 900 functions in substantially the same manner as the line arrester 100.

In closing, it should again be emphasized that the above-described embodiments of the invention are intended to be illustrative only. Other embodiments can use different types and arrangements of elements for implementing the described functionality, and these numerous alternative embodiments within the scope of the appended claims will be apparent to one skilled in the art. In addition, it is reiterated that all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

Moreover, any element in a claim that does not explicitly state "means for" performing a specified function or "step for" performing a specified function is not to be interpreted as a "means for" or "step for" clause as specified in 35 U.S.C. §112, Paragraph 6. In particular, the use of "step of" in the claims herein is not intended to invoke the provisions of 35 U.S.C. §112, Paragraph 6.

What is claimed is:

1. An arrester for preventing an insulator supporting a power line from experiencing an electrical flashover, the arrester comprising:

an electrode, the electrode spaced apart from: (a) the power line, or (b) a conductor that is distinct from the power line, so as to define an external gap therebetween;

a varistor;

a separating device, the separating device comprising two portions operative to separate from one another when the varistor experiences an electrical condition sufficient to cause the varistor to fail; and a strap, the strap being continuous and defining two ends, each of the two ends coupled to a respective one of the two portions of the separating device;

wherein the electrode, the external gap, the separating device, and the varistor are arranged in electrical series with one another and in electrical parallel with the insulator;

wherein the strap is operative to span between the two portions of the separating device after the separating device separates into the two portions.

2. The arrester of claim 1, wherein the strap is substantially flexible.

3. The arrester of claim 1, wherein the strap is operative to allow one of the two portions of the separating device to be suspended from the other after the separating device separates into the two portions.

4. The arrester of claim 1, wherein the strap is operative to allow at least the electrode to be suspended from one of the two portions of the separating device after the separating device separates into the two portions.

5. The arrester of claim 1, wherein the strap is operative to allow at least the varistor to be suspended from one of the two portions of the separating device after the separating device separates into the two portions.

6. The arrester of claim 1, wherein the arrester is arranged such that the electrode is coupled to the separating device, and the separating device is coupled to the varistor.

7. The arrester of claim 1, wherein the arrester is arranged such that the electrode is coupled to the varistor, and the varistor is coupled to the separating device.

8. The arrester of claim 1, wherein the insulator comprises a terminal that is tied to an earth potential.

9. The arrester of claim 1, wherein the arrester is adapted for use on a utility pole.

10. The arrester of claim 1, wherein the separating device comprises an explosive device.

11. The arrester of claim 9, wherein the explosive device is heat activated.

12. The arrester of claim 1, wherein the varistor comprises a series varistor unit.

13. The arrester of claim 1, wherein the varistor is characterized by a higher resistance at a lower applied voltage, and a lower resistance at a higher applied voltage.

14. The arrester of claim 1, wherein a capacity of the insulator to experience an electrical flashover after the separating device separates into the two portions is substantially equal to a capacity of the insulator to experience an electrical flashover without the arrester.

15. The arrester of claim 1, wherein the varistor comprises one or more non-linear metal oxide resistors.

16. The arrester of claim 1, wherein the insulator comprises at least one of a suspension-type, a post-type, a pin-type, and a crossarm-type insulator.

17. A method for preventing an insulator supporting a power line from experiencing an electrical flashover, the method comprising the steps of:

positioning an electrode apart from: (a) the power line, or (b) a conductor that is distinct from the power line, so as to define an external gap therebetween;

receiving a varistor;

receiving a separating device, the separating device comprising two portions operative to separate from one another when the varistor experiences an electrical condition sufficient to cause the varistor to fail;

receiving a strap, the strap being continuous and defining two ends;

arranging the strap such that each of the two ends is coupled to a respective one of the two portions of the separating device; and arranging the electrode, the external gap, the separating device, and the varistor in electrical series with one another and in electrical parallel with the insulator;

wherein the strap is operative to span between the two portions of the separating device after the separating device separates into the two portions.

18. An apparatus comprising:

an insulator, the insulator supporting a power line;

an electrode, the electrode spaced apart from: (a) the power line, or (b) a conductor that is distinct from the power line, so as to define an external gap therebetween;

a varistor;

a separating device, the separating device comprising two portions operative to separate from one another when the varistor experiences an electrical condition sufficient to cause the varistor to fail; and a strap, the strap being continuous and defining two ends, each of the two ends coupled to a respective one of the two portions of the separating device;

wherein the electrode, the external gap, the separating device, and the varistor are arranged in electrical series with one another and in electrical parallel with the insulator;

wherein the strap is operative to span between the two portions of the separating device after the separating device separates into the two portions.

19. The line arrester of claim 1, wherein the conductor is electrically tied to the power line.

* * * * *